US012077253B2

(12) United States Patent
Labatte

(10) Patent No.: US 12,077,253 B2
(45) Date of Patent: Sep. 3, 2024

(54) WATERCRAFT ACCESSORY

(71) Applicant: Jay Labatte, Kelowna (CA)

(72) Inventor: Jay Labatte, Kelowna (CA)

( * ) Notice: Subject to any disclaimer, the term of this patent is extended or adjusted under 35 U.S.C. 154(b) by 50 days.

(21) Appl. No.: 17/656,996

(22) Filed: Mar. 29, 2022

(65) Prior Publication Data

US 2023/0312060 A1 Oct. 5, 2023

(51) Int. Cl.

| | |
|---|---|
| ***B63B 32/40*** | (2020.01) |
| ***B63B 25/00*** | (2006.01) |
| ***B63B 32/77*** | (2020.01) |
| ***B63B 45/04*** | (2006.01) |

(52) U.S. Cl.

CPC ..... *B63B 32/40* (2020.02); *B63B 25/002* (2013.01); *B63B 32/77* (2020.02); *B63B 45/04* (2013.01)

(58) Field of Classification Search

CPC ..... B63B 32/00; B63B 32/40; B63B 32/70; B63B 32/77; B63B 45/00; B63B 45/02; B63B 69/00

USPC ..... 114/55.5, 343, 364; 441/65, 74, 136

See application file for complete search history.

(56) References Cited

U.S. PATENT DOCUMENTS

| | | | | |
|---|---|---|---|---|
| 6,367,403 | B1 * | 4/2002 | Carter | A01K 97/06 114/364 |
| 10,214,267 | B2 * | 2/2019 | Robertson | B63B 34/21 |
| 11,034,422 | B2 * | 6/2021 | Myer | B63H 5/02 |

* cited by examiner

*Primary Examiner* — Daniel V Venne

(74) *Attorney, Agent, or Firm* — Orin Del Vecchio

(57) ABSTRACT

A watercraft accessory operable to be secured to the deck of a paddleboard and provide storage of a plurality of items. The watercraft accessory of the present invention includes a housing having a top, bottom and a plurality of wall integrally formed to create an interior volume. A first storage compartment and a second storage compartment are secured within the rear wall and are slidably mounted thereto. A third storage compartment is secured to a side wall and is configured to provide additional storage. At least one storage compartment is sealably secured within the housing and another is thermally isolated. The housing further includes navigation lights and a bow light secured thereto. An audio player is further provided and the housing includes integral mounts to facilitate securing to the deck of the paddleboard. An internally located power supply provides the necessary electrical power.

11 Claims, 3 Drawing Sheets

WATERCRAFT ACCESSORY

FIELD OF THE INVENTION

The present invention relates generally to watercraft paraphernalia, more specifically but not by way of limitation, a watercraft accessory that is configured to be releasably secured to a deck of a watercraft wherein the present invention provides a plurality of compartments to store items and additionally includes alternate elements such as but not limited to navigation lights and audio equipment.

BACKGROUND

As is known in the art, there are a plurality of different types of watercraft including vessels such as but not limited to power boats and sailing craft. One category of marine vessels are human powered and this category includes vessels such as but not limited to canoes, kayaks and paddleboards. For these types of vessels they are typically powered by paddles or other apparatus that requires physical effort from the user. These vessels are all typically low profile and sit very low in the water. This category also typically has an open deck environment with most often no storage elements of any kind.

One issue in particular with paddleboards is the inability to store items such as but not limited to food and other items that the user may desire to keep dry. If a user desires to bring food and perhaps other items that need to remain dry this will often result in the user packing an ice chest as well as a specialized bag that is capable of storing goods and keeping them dry. This can be quite cumbersome and with limited room on the deck of a paddleboard can create issues in carrying the desired items.

Accordingly, there is a need for a watercraft accessory designed for a paddleboard or similar watercraft wherein the watercraft accessory is configured to be releasably secured to the deck of the watercraft and provide thermal storage, dry storage as well as include navigation lights and audio equipment.

SUMMARY OF THE INVENTION

It is the object of the present invention to provide a watercraft accessory that is configured to provide storage of items such as but not limited to food and other goods wherein the present invention includes a housing wherein the housing includes a bottom, a plurality of walls and a top all integrally formed to create an interior volume.

Another object of the present invention is to provide a carrying apparatus for a paddleboard that is operable to provide thermal storage and dry storage for desired items wherein the housing includes a first rear compartment and a second rear compartment that are slidably coupled with the housing.

A further object of the present invention is to provide a watercraft accessory that is configured to provide storage of items such as but not limited to food and other goods wherein the first rear compartment is configured to provide thermal storage of food and similar items.

Still another object of the present invention is to provide a carrying apparatus for a paddleboard that is operable to provide thermal storage and dry storage for desired items wherein the second rear compartment is slidably coupled to the housing and is configured to provide dry storage for items disposed therein.

An additional object of the present invention is to provide a watercraft accessory that is configured to provide storage of items such as but not limited to food and other goods wherein the housing further includes a side compartment that is slidably coupled with the housing and can be configured to provide dry storage for items disposed therein.

Yet a further object of the present invention is to provide a carrying apparatus for a paddleboard that is operable to provide thermal storage and dry storage for desired items wherein the present invention further includes navigation lights operably coupled to the housing.

Another object of the present invention is to provide a watercraft accessory that is configured to provide storage of items such as but not limited to food and other goods that further includes a power supply disposed in the interior volume of the housing and further includes a photovoltaic charger operably coupled thereto.

Still another object of the present invention is to provide a carrying apparatus for a paddleboard that is operable to provide thermal storage and dry storage for desired items wherein the housing has mounted therein audio equipment configured to provide broadcast of audio sounds and signals.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
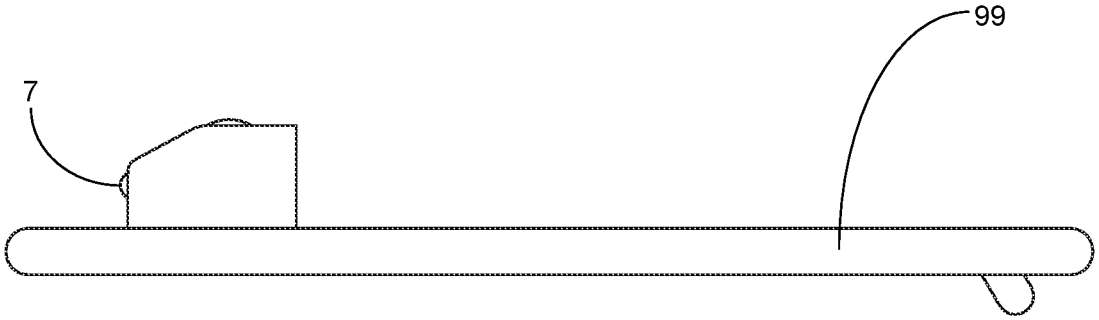
FIG. 1 is side view of the present invention secured to an exemplary paddleboard.
Figure 2:
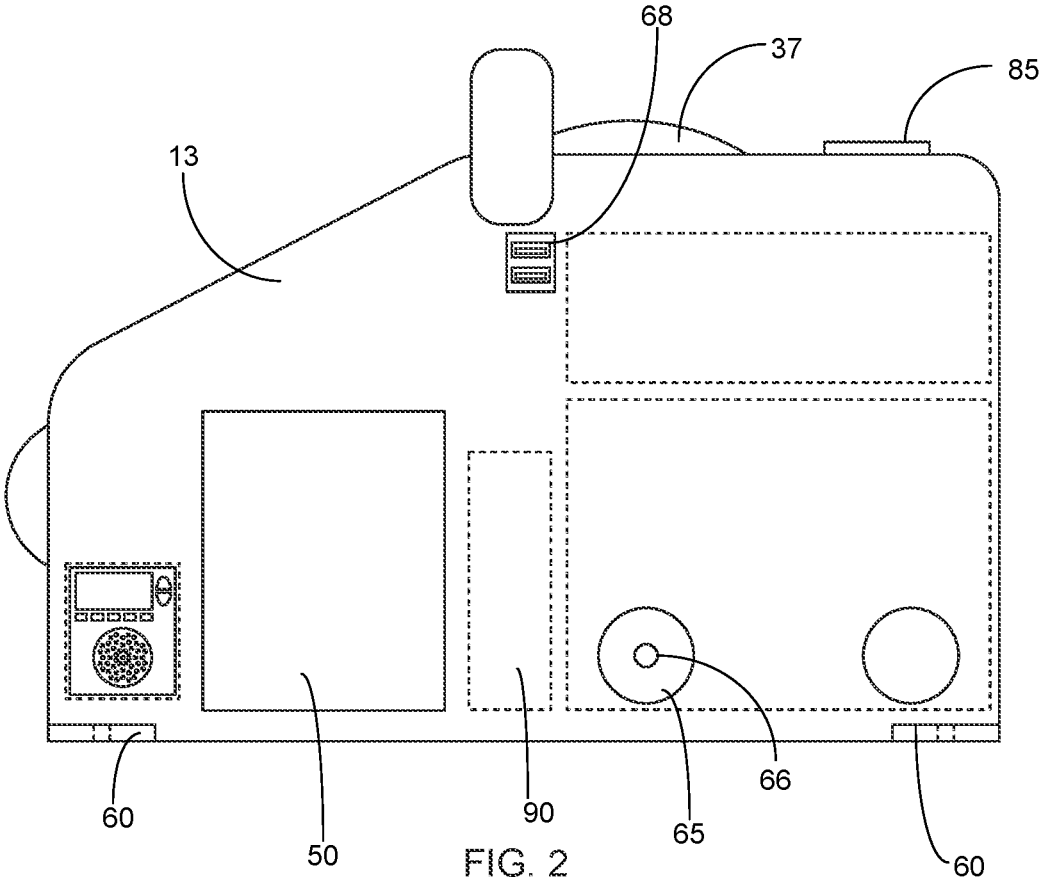
FIG. 2 is a left side view of the present invention illustrating audio and internal components disposed in the housing.
Figure 3:
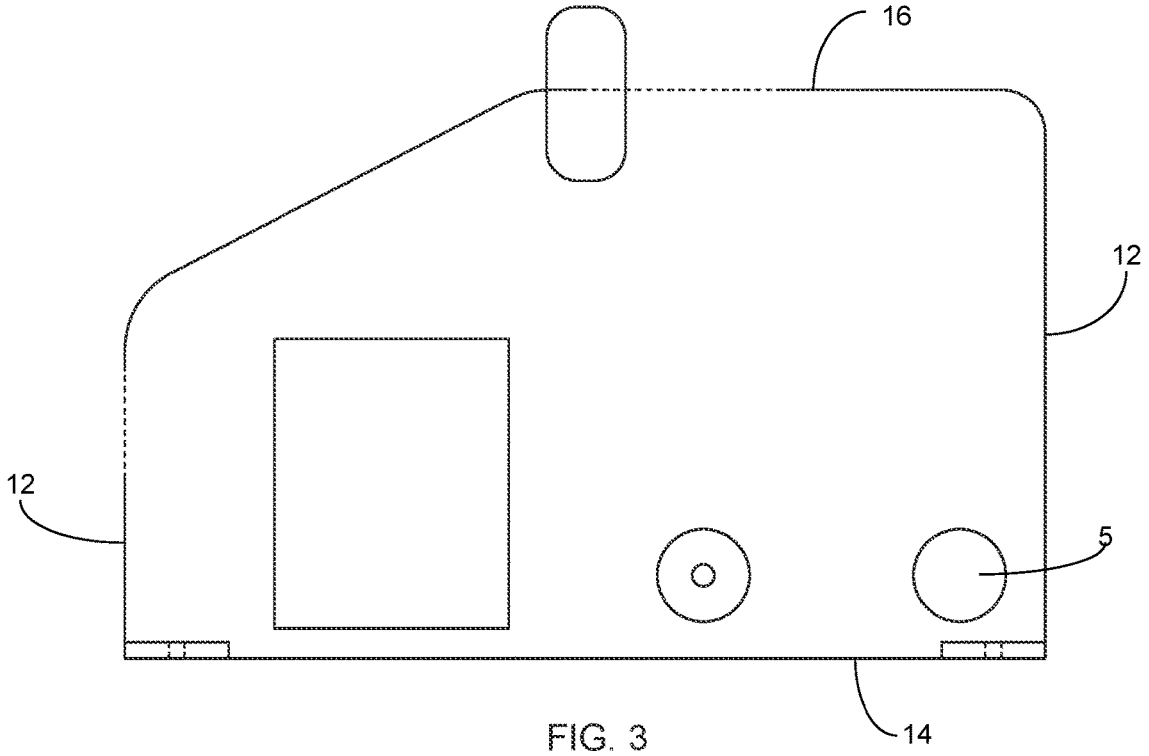
FIG. 3 is a left side view of the present invention.
Figure 4:
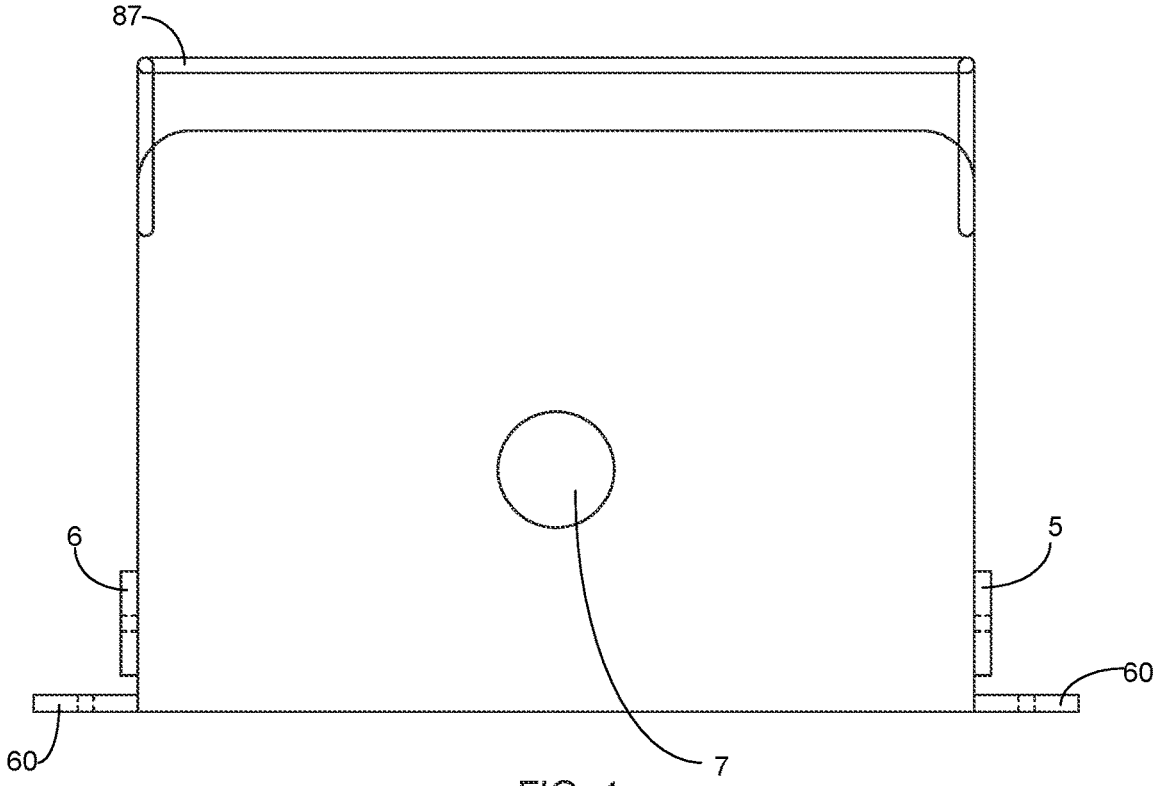
FIG. 4 is a front view of the present invention.

Referring now to the drawings submitted herewith, wherein various elements depicted therein are not necessarily drawn to scale and wherein through the views and figures like elements are referenced with identical reference numerals, there is illustrated a watercraft accessory 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted as a part hereof, the watercraft accessory 100 includes a housing 10. The housing 10 includes a plurality of walls 12, a bottom 14 and a top 16 being integrally formed to create an interior volume. The housing 10 is manufactured from a durable lightweight weatherproof material such as but not limited to plastic. It should be understood within the scope of the present invention that the housing 10 could be provided in alternate sizes so as to be releasably secured to watercraft of different sizes. While the preferred embodiment discussed herein is configured to be placed proximate the bow of a paddleboard 99, it is contemplated within the scope of the present invention that the watercraft accessory 100 could be configured to be releasably secured to other types of watercraft.

Figure 5:
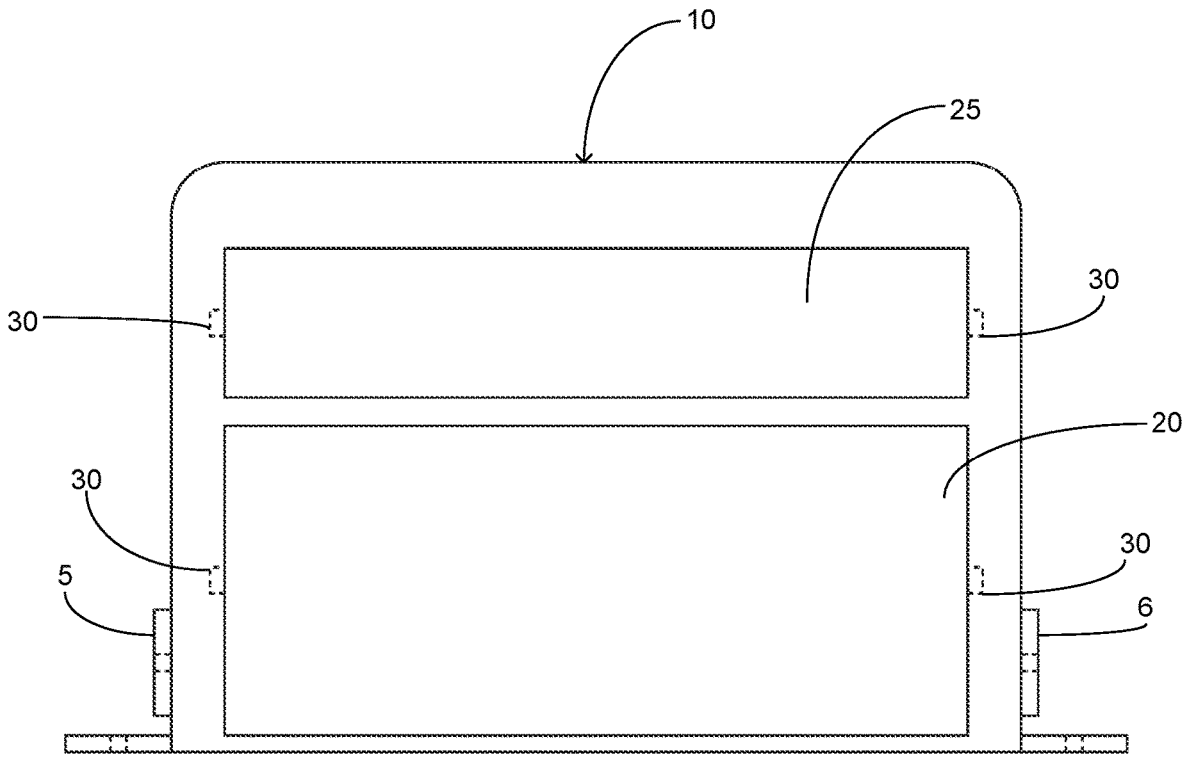
FIG. 5 is a rear view of the present invention.

Referring in particular to FIG. 5, the housing 10 includes a first storage compartment 20 and a second storage compartment 25. The first storage compartment 20 and the second storage compartment 25 are slidably mounted within the interior volume of the housing 10 utilizing mounts 30. Both the first storage compartment 20 and the second storage compartment 25 are configured to be open and closes in a drawer like manner. The first storage compartment 20 is proximate the bottom 14 and has a capacity that is greater than that of the second storage compartment 25. The first storage compartment 20 is configured to provide thermal isolation from the environmental surroundings in which the watercraft accessory 100 is located. The interior of the first storage compartment 20 is configured to receive ice or similar cooling material and maintain a temperature that is cooler than the surroundings of the watercraft accessory 100. The second storage compartment 25 is sealably secured within the housing 10 so as to ensure the interior volume of the second storage compartment 25 remains dry. It is contemplated within the scope of the present invention that the second storage compartment 25 could employ o-rings or other suitable elements to inhibit the ability for water to egress into the interior volume of the second storage compartment 25. It should be understood within the scope of the present invention that the sizes of the first storage compartment 20 and the second storage compartment 25 could vary.

The housing 10 has secured thereto on the walls 12 vessel navigation lights 5, 6 and a bow light 7. The vessel navigation lights 5,6 are conventional marine navigation lights having the port side red and the starboard side green in color. The bow light 7 is a LED white light that is usable for illuminating an area in front of the paddleboard 99. The vessel navigation lights 5,6 and bow light 7 are electrically coupled to the power supply 90 and controlled by switch interface 85. The watercraft accessory 100 further includes an audio unit 40 wherein the audio unit 40 is mounted to the side of the housing 10 in the wall 12 thereof. It is contemplated within the scope of the present invention that the audio unit 40 is a radio receiver as well as a Bluetooth controllable unit capable of receiving a sound signal and transmitting to speaker 37 mounted to the housing 10. The audio unit 40 is electrically coupled to the power supply 90 providing operation thereof. In some embodiments of the present invention the audio unit 40 can be operably coupled to the switch interface 85 for operation thereof.

The watercraft accessory 100 further includes a third storage compartment 50 mounted to the left wall 13 of the housing 10. The third storage compartment 50 includes an interior volume that is configured to receive and retain items therein. In a preferred embodiment of the watercraft accessory 100 the third storage compartment 50 is configured to be sealably secured so as to inhibit water from penetrating thereinto. It should be understood within the scope of the present invention that the third storage compartment 50 could be configured in alternate manners in place of being configured for dry storage. Additionally, it should be understood within the scope of the present invention that the third storage compartment 50 could be movably coupled wherein the third storage compartment 50 either hingedly moves between and open and closed position or slidably moves between an open and closed position.

Integrally formed into the housing 10 proximate the front and rear edges thereof are mounting plates 60. The mounting plates 60 are manufactured from metal or other suitable material and provide a technique to releasably secure the watercraft accessory 100 to the paddleboard 99. It should be understood within the scope of the present invention that the watercraft accessory 100 could be releasably secured to the paddleboard 99 utilizing a combination of fasteners and the mounting plates 60 or utilizing various other techniques and elements. It should be further understood within the scope of the present invention that the watercraft accessory 100 could be releasably secured utilizing hook and loop fasteners or other similar technology. A threaded insert 65 is secured to the left wall 13 of the housing 10. The threaded insert 65 includes a threaded central aperture 66 that is configured to receive, mount and secure various accessories such as but not limited to a safety flag pole. A pair of USB ports 68 are mounted in the wall 12 of the housing 10. The USB ports 68 are electrically coupled to the power supply 90.

The power supply 90 is a rechargeable power source such as but not limited to a lithium ion battery. It is contemplated within the scope of the present invention that the power supply 90 is configured to be removable for charging or have an accessible charging port. A handle 87 is secured to the housing 10 and extends thereacross being mounted to opposing sidewalls. The handle 87 is pivotally mounted utilizing conventional fasteners and is operable to provide a technique to carry the watercraft accessory 100. It should be understood within the scope of the present invention that the handle 87 could be provided in various shapes and sizes. While not specifically illustrated herein, it is contemplated within the scope of the present invention that the housing 10 has mounted to the top 16 a photovoltaic panel that is electrically coupled to the power supply 90 so as to provide charging thereof.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A watercraft accessory configured to be secured to a deck of a watercraft wherein the watercraft accessory comprises:

a housing, said housing having a bottom, a top and a plurality of walls integrally formed to create an interior volume, said housing having a rear wall, said housing being manufactured from a weatherproof material, said housing further having a handle secured thereto proximate the top thereof;

a first storage compartment, said first storage compartment movable coupled to the rear wall, said first storage compartment being proximate the bottom of said housing, said first storage compartment having a first position and a second position wherein in said first position said first storage compartment is disposed within the interior volume of said housing;

a second storage compartment, said second storage compartment being movably mounted within said housing on said rear wall, said second storage compartment being located above said first storage compartment, said second storage compartment being slidably mounted within said housing so as to slide in and out of the interior volume of said housing;

navigation lights, said navigation lights consisting of a first light and a second light, said first light being secured to a left side of the housing, said second light being secured to a right side of said housing; and wherein the watercraft accessory is operable to provide dry storage for items as well as provide thermally isolated storage for additional items.

2. The watercraft accessory configured to be secured to the deck of the watercraft as recited in claim 1, and further including a third storage compartment, said third storage compartment being mounted in a sidewall of said housing, and said third storage compartment being sealably secured to said housing so as to inhibit water from egressing thereinto.

3. The watercraft accessory configured to be secured to the deck of the watercraft as recited in claim 2, and further including a bow light, said bow light being mounted to a front wall of said housing, said bow light operable to illuminate an area in front of the watercraft.

4. The watercraft accessory configured to be secured to the deck of the watercraft as recited in claim 3, wherein said housing further includes a plurality of mounts, said plurality of mounts being located proximate said bottom of said housing, said plurality of mounts configured to assist in securing the housing to the deck of the watercraft.

5. The watercraft accessory configured to be secured to the deck of the watercraft as recited in claim 4, and further including at least one threaded insert, said at least one threaded insert being secured to the housing, said at least one threaded insert having a threaded aperture.

6. The watercraft accessory configured to be secured to the deck of the watercraft as recited in claim 5, and further including an audio player, said audio player being mounted to said housing, said audio player being operably coupled to a speaker.

7. The watercraft accessory configured to be secured to the deck of the watercraft as recited in claim 6, and further including a switch interface, said switch interface being mounted to the top of said housing, said switch interface being operably coupled to said audio player, said bow light and said navigation lights.

8. The watercraft accessory configured to be secured to the deck of the watercraft as recited in claim 7, wherein said first storage compartment is thermally isolated so as to maintain a temperature in an interior volume thereof that is lower than that of its surroundings.

9. The watercraft accessory configured to be secured to the deck of the watercraft as recited in claim 8, wherein said second storage compartment is sealably secured so as to inhibit water from egressing into an interior volume thereof.

10. The watercraft accessory configured to be secured to the deck of the watercraft as recited in claim 9, wherein the housing has disposed in the interior volume thereof a power supply, said power supply operably coupled to audio player, said bow light and said navigation lights.

11. A paddleboard accessory configured to be secured to a deck of a paddleboard wherein the paddleboard accessory comprises:

a housing, said housing having a bottom, a top and a plurality of walls integrally formed to create an interior volume, said housing having a rear wall, said housing being manufactured from a weatherproof material, said housing further having a handle secured thereto proximate the top thereof, wherein said housing further includes a plurality of mounts, said plurality of mounts being located proximate said bottom of said housing, said plurality of mounts configured to assist in securing the housing to the deck of the paddleboard, wherein said housing further has at least one threaded insert, said at least one threaded insert being secured to the housing, said at least one threaded insert having a threaded aperture;

a first storage compartment, said first storage compartment movable coupled to the rear wall, said first storage compartment being proximate the bottom of said housing, said first storage compartment having a first position and a second position wherein in said first position said first storage compartment is disposed within the interior volume of said housing, said first storage compartment is thermally isolated so as to maintain a temperature in an interior volume thereof that is lower than that of its surroundings;

a second storage compartment, said second storage compartment being movably mounted within said housing on said rear wall, said second storage compartment being located above said first storage compartment, said second storage compartment being slidably mounted within said housing so as to slide in and out of the interior volume of said housing, said second storage compartment is sealably secured so as to inhibit water from egressing into an interior volume thereof;

a third storage compartment, said third storage compartment being mounted in a sidewall of said housing, said third storage compartment being sealably secured to said housing so as to inhibit water from egressing thereinto;

navigation lights, said navigation lights consisting of a first light and a second light, said first light being secured to a left side of the housing, said second light being secured to the right side of said housing;

an audio player, said audio player being operably coupled to a speaker; and a bow light, said bow light being secured to a front wall of said housing.

* * * * *